US005131114A

United States Patent [19]

Sunagawa et al.

[11] Patent Number: 5,131,114

[45] Date of Patent: Jul. 21, 1992

[54] VACUUM CLEANER

[75] Inventors: Masao Sunagawa, Mito; Kouiti Sagawa, Hitachi, both of Japan

[73] Assignee: Hitachi, Ltd., Tokyo, Japan

[21] Appl. No.: 594,709

[22] Filed: Oct. 9, 1990

[30] Foreign Application Priority Data

Oct. 13, 1989 [JP] Japan ..... 1-264935

[51] Int. Cl.[5] ..... A47L 9/00

[52] U.S. Cl. ..... 15/323; 15/327.2; 15/327.6

[58] Field of Search ..... 15/323, 327.1, 327.2, 15/327.6

[56] References Cited

U.S. PATENT DOCUMENTS

| | | | |
|---|---|---|---|
| 1,937,792 | 12/1933 | Schreiber | 15/327.1 X |
| 2,475,815 | 7/1949 | Burd | 15/327.1 X |
| 2,734,594 | 2/1956 | Meeker | 15/327.1 X |
| 2,771,151 | 11/1956 | Osborn | 15/327.6 X |
| 2,956,734 | 10/1960 | Doyle | 15/327.1 X |
| 3,101,889 | 8/1963 | Tatge | 15/328 X |
| 3,149,362 | 9/1964 | Smithson | 15/327.1 |
| 4,355,434 | 10/1982 | Gongwer | 15/327.1 |

FOREIGN PATENT DOCUMENTS

| | | | |
|---|---|---|---|
| 362895 | 4/1990 | European Pat. Off. | 15/327.1 |

*Primary Examiner*—Chris K. Moore

*Attorney, Agent, or Firm*—Antonelli, Terry, Stout & Kraus

[57] ABSTRACT

A vacuum cleaner including a main vacuum cleaner body having a plurality of caster mounting portions, respectively accommodating a caster, provided on a lower case of the vacuum cleaner main body, with the suction hose being turnably mounted substantially at a central portion of the upper case of the vacuum cleaner main body. A distance between an installation position of the suction hose and the respective caster mounting portions is substantially equal such that when the vacuum cleaner main body collides with an obstacle located on a surface to be cleaned by the vacuum cleaner, the suction hose can move easily and the vacuum cleaner main body can move and turn easily in a pulling direction of the suction hose to avoid the obstacle.

5 Claims, 2 Drawing Sheets

VACUUM CLEANER

BACKGROUND OF THE INVENTION

The present invention relates to a vacuum cleaner for cleaning a floor, tatami, and carpet and, more particularly, to a vacuum cleaner including a plurality of caster mounting means respectively mounting casters directly on a cleaner main body without providing a caster mounting base.

A vacuum cleaner is proposed in, for example, Japanese Utility Model Publication No. 29421/1968, wherein a cleaner main body of the vacuum cleaner is turnably supported on a wheel mounting base having casters for enabling a moving of the vacuum cleaner over the surface to be cleaned.

In the above proposed vacuum cleaner, since a wheel mounting base is added to the generally provided vacuum cleaner structure, the weight and height of the cleaner main body of the vacuum cleaner is increased, thereby adversely affecting handling of the vacuum cleaner.

In the proposed vacuum cleaner, a plurality of caster mounting means for respectively mounting the casters are installed integrally in the wheel mounting base, with the casters being adapted to run along the surface to be cleaned. The wheel mounting base can turn independently relative to the cleaner main body of the vacuum cleaner. Namely, the plurality of casters can move and run individually relative to the cleaner main body of the vacuum cleaner.

SUMMARY OF THE INVENTION

An object of the present invention is to provide a vacuum cleaner which improves the overall handling of the vacuum cleaner.

Another object of the present invention is to provide a vacuum cleaner wherein a cleaner main body of a vacuum cleaner can run smoothly on a surface to be cleaned without the main body of the vacuum cleaner tilting or otherwise being displaced from a normal operating position.

A further object of the present invention is to provide a vacuum cleaner wherein a cleaner main body of the vacuum cleaner can more readily avoid obstacles normally encountered during a vacuuming operation.

A further object of the present invention is to provide a vacuum cleaner having a reduced weight and reduced height of the cleaner main body.

In accordance with the present invention, a vacuum cleaner comprises a cleaner main body, a suction hose for introducing dust into the cleaner main body and moving means for enabling the cleaner main body to be moved over the surface to be cleaned. The suction hose is turnably mounted at a substantially central portion of an upper face of the cleaner main body, and the cleaner main body is turnable by the cooperation between the moving means and an obstacle on the surface being cleaned.

When an operator pulls the suction hose, since the suction hose is mounted at a substantially central portion of the upper face of the cleaner main body, the suction hose can move easily in a pulling direction, and by the moving means, the cleaner main body can move smoothly in the pulling direction.

During a vacuuming, the cleaner main body may collide with an obstacle on the cleaning surface, then the cleaner main body can turn around the hose mounting portion of the suction hose, and, by avoiding the obstacle, the cleaner main body can move or turn in the pulling direction of the suction hose. Further, since there is no wheel mounting base on the cleaner main body, the weight and height of the cleaner main body can be reduced.

According to the present invention, in a vacuum cleaner comprising a cleaner main body, a suction hose for introducing dust into the cleaner main body and a moving means for enabling a moving of the cleaner body over a surface to be cleaned, the suction hose is turnably mounted on a substantially central portion of an upper face of the cleaner main body, with the cleaner main body being turnable by cooperation of the moving means with an obstacle on the surface to be cleaned.

DESCRIPTION OF THE INVENTION

Figure 1:
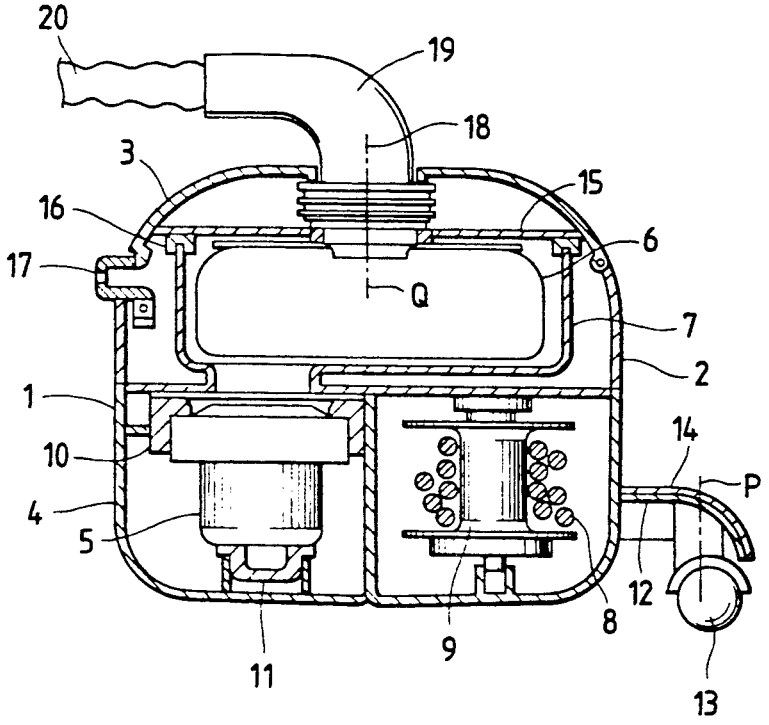
FIG. 1 is a longitudinal cross-sectional view of a portion of one embodiment of a vacuum cleaner according to the present invention.

As shown in FIG. 1, a substantially round cleaner main body 1 of the vacuum cleaner of the present invention includes an upper case 2, a dust collecting cover 3 and a lower case 4. An upper surface of the upper case 2 is formed with a smoothly curved shape.

An electric driven blower motor 5 is installed in an inner portion of the cleaner main body 1, with the electric driven blower motor 5 generating a suction force. A dust collecting portion 7, accommodating a filter member 6, and a cord reel winding apparatus 9 for winding a power source cord 8 are also installed in the cleaner main body 1.

The electric driven blower motor 5 is elastically supported by a large vibration-suppressing rubber member 10 and a small vibration-suppressing rubber member 11, with the vibration-suppressing members 10, 11 preventing a direct transfer of vibrations to an outside portion of the cleaner body 1.

Four caster mounting portions 12*a*, 12*b*, 12*c* and 12*d* are provided on the lower case 2 and respectively turnably support four casters 13 as moving means for the cleaner body 1, with a bumper 14 being provided for preventing scratching or damaging of furniture. The casters 13 are mounted on a bottom portion of the lower case 3 of the cleaner main body 1. The caster mounting portions 12*a*, 12*b*, 12*c* and 12*d* project radially outwardly from a side portion of the cleaner main body 1.

An inner wall portion 15 is provided on an inner side of the dust collecting cover 3, and, along with a packing or seal member 16, forms an air-tight seal for the dust collecting portion 7. The dust collecting portion 7 is opened and closed by manipulating a clamp 17.

The dust collecting cover 3 is positioned at an upper portion of the cleaner main body 1 and a hose mounting portion 18 is provided at a substantially central portion of the upper case 2 of the cleaner main body 1. The hose mounting portion or hose installing portion 18 is turnably connected to a suction hose 20 by a substantially L-shaped hose coupling 19, as shown in FIG. 1, such that the suction hose 20 is turnable about a turning axis Q.

The turning axis Q of the hose coupling 19 extends substantially parallel to a mounting axis P of each of the caster mounting portions 12*a*, 12*b*, 12*c* and 12*d*. The hose coupling 19 may be rotatably over substantially a 360° angle (not shown) may be limited to substantially two substantially a 180° angle.

Figure 2:
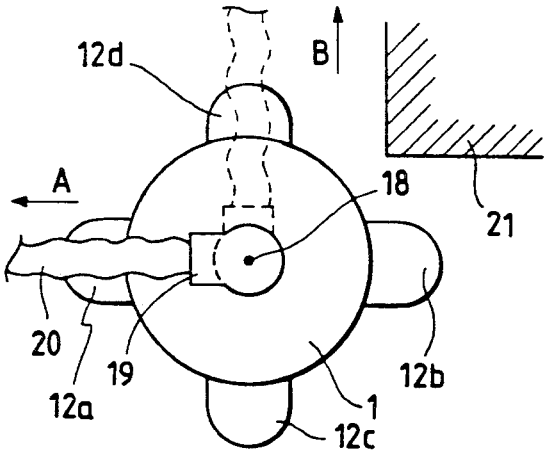
FIG. 2 is a schematic top view of one embodiment of a vacuum cleaner according to the present invention.

Further, distances d1, d2, d3, and d4 between the hose mounting portion at each of the plurality of caster mounting portions 12*a*, 12*b*, 12*c*, 12*d* are set so as to have substantially the same length, as shown in FIG. 2.

When an operator is vacuuming in a direction of the arrow A (FIG. 2) and moves the vacuum cleaner in a direction of the arrow B, since the suction hose is turnable at the substantially central portion of the upper portion of the cleaner main body 1, via the hose coupling 19, the suction hose can be rotated easily to a position indicated in phantom line and can be turned in the direction of the arrow B.

Figure 3:
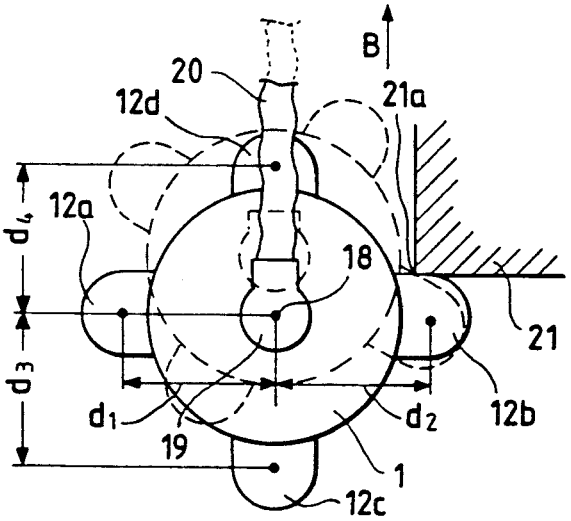
FIG. 3 is a schematic top view of the vacuum cleaner of FIG. 2 avoiding an obstacle located on a surface to be cleaned.

When the operator then pulls the cleaner main body 1 in the direction of the arrow B and encounters an obstacle 21, as shown in FIG. 3, a collision point 21*a* of the caster mounting portion 12*b* against the obstacle 21 works as fulcrum point and then the cleaner main body can be rotated around the hose mounting portion 18 as a center for turning and the cleaner main body 1 can be moved so as to avoid the obstacle 21 by the cleaner main body assuming a position indicated in phantom line in FIG. 3.

Further since distances $d_1$, $d_2$, $d_3$, and $d_4$ between the hose mounting portion 18 and each of the plurality of caster mounting portions 12*a*, 12*b*, 12*c* and 12*d* are substantially the same, that is, $d=d_2=d_3=d_4$, when any one of the caster mounting portions 12*a*, 12*b*, 12*c*, or 12*d* collides with the obstacle 21, it is possible to avoid the obstacle 21 by virtue of substantially the same force or substantially the same moment.

Further, since the distances $d_1$, $d_2$, $d_3$, and $d_4$ between each of the caster mounting portions 12*a*, 12*b*, 12*c*, and 12*d* and the hose mounting portion 18 are substantially the same length, regardless of which of the caster mounting portions 12*a*, 12*b*, 12*c* or 12*d* may hit against the obstacle 21, the cleaner main body 1 can avoid the obstacle 21 by application of substantially the same force due to the substantially same distance ratio, and, accordingly, the operation feeling for the operator remains the same.

Figure 4:
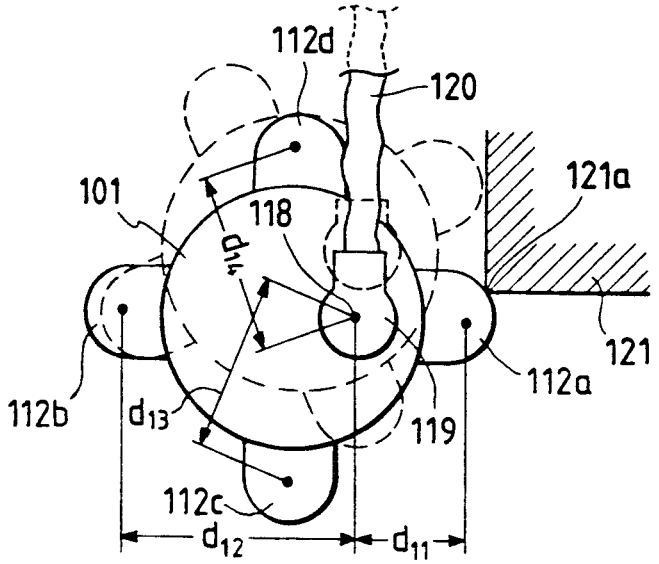
FIG. 4 is a schematic top view of one comparative example of a vacuum cleaner hitting an obstacle located on a surface to be cleaned.
Figure 5:
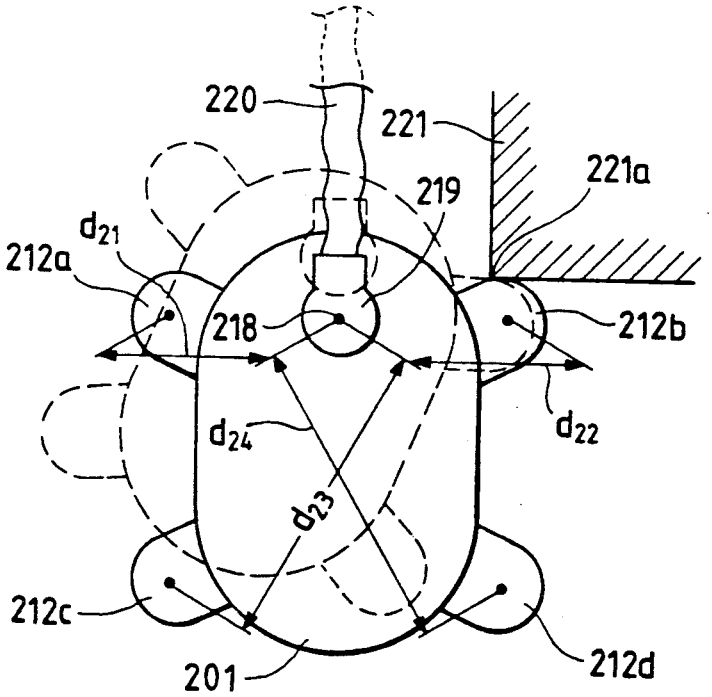
FIG. 5 is a schematic top view of another comparative example of a vacuum cleaner hitting an obstacle located on the surface to be cleaned.

The significant advantages of the vacuum cleaner of the present invention are best understood when compared with the comparative examples of FIGS. 4 and 5.

The vacuum cleaner shown in FIG. 4 has a round shaped cleaner main body 101. The vacuum cleaner comprises a cleaner main body 101 and four caster mounting portions 112*a*, 112*b*, 112*c*, and 112*d*. A hose coupling 119 is mounted on the cleaner main body 101. A suction hose 120 is connected to the hose coupling 119. A hose mounting portion 118 for the suction hose 120 or the hose installation position is not disposed at a central portion of the cleaner main body 101 but is offset to a side portion of the upper face of the cleaner main body 101.

In this vacuum cleaner structure, the distance $d_{13}$ between the caster mounting portion 112*c* and the hose mounting portion 118 is equal to the distance $d_{14}$ between the caster mounting portion 112*d* and the hose mounting portion 118.

However, both the distance $d_{11}$ between the caster mounting portion 112*a* and the hose mounting portion 118 and the distance $d_{12}$ between the caster mounting portion 112*b* and the hose mounting portion 118 differ from the distance $d_{13}$ between the caster mounting portion 112*c* and the hose mounting portion 118 or the distance $d_{14}$ between the caster mounting portion 112*d* and the hose mounting portion 118, respectively. Namely, the relationship between the distance is $d_{11}<d_{13}=d_{13}<d_{12}$.

In the above described vacuum cleaner having the round shape cleaner main body 101, when the caster mounting portion 112*a*, the caster mounting portion 112*c* and the caster mounting portion 112*d*, each of which has the shorter distance $d_{11}$, $d_{13}$ and $d_{14}$ in comparison with the distance $d_{12}$, hits against an obstacle 121, the force required for the avoidance of the obstacle 121 becomes a moment force.

For example, as shown in FIG. 4, when the caster mounting portion 112*a* hits the obstacle 121, then a collision portion 121 becomes a fulcrum point. Therefore, since the distance ratio becomes large or the distance $d_{11}$ is shorter than that of the distance $d_{12}$, the operation characteristic property of the vacuum cleaner may be lowered.

The vacuum cleaner shown in FIG. 5 has an oval shaped cleaner main body 201 and comprises a cleaner main body 201 and four caster mounting portions 212*a*, 212*b*, 212*c*, and 212*d*. A hose coupling 219 is mounted on the cleaner main body 201. A suction hose 220 is connected to the hose coupling 219. A hose mounting portion 218 for the suction hose 220 or the hose installing position is not disposed at a central portion of the cleaner main body 201 but is offset to a side portion of the upper face of the cleaner main body 201. The distance $d_{21}$ between the caster mounting portion 112*a* and the hose mounting portion 218 is equal to the distance $d_{22}$ between the caster mounting portion 212*b* and the hose mounting portion 218. The distance $d_{23}$ between the caster mounting portion 212*c* and the hose mounting portion 218 is equal to the distance $d_{24}$ between the caster mounting portion 212*d* and the hose mounting portion 218.

However, the distance $d_{21}$ between the caster mounting portion 212*a* and the hose mounting portion 218 or the distance $d_{22}$ between the caster mounting portion 212*b* and the hose mounting portion 218 differs from the distance $d_{23}$ between the caster mounting portion 212*c* and the hose mounting portion 218 or the distance $d_{24}$ between the caster mounting portion 212*d* and the hose mounting portion 218. Namely, the relationship between these distance is $d_{21}=d_{22}<d_{23}=d_{24}$.

With the oval shaped cleaner main body 201 when the caster mounting portion 212*a* and the caster mounting portion 212*b*, each of which has the shorter distances $d_{21}$ and $d_{22}$, compared with the distances $d_{23}$ and $d_{24}$ hits the obstacle 221, the force for requiring 221 becomes a moment force.

For example, as shown in FIG. 5, when the caster mounting portion 212*b* hits the obstacle 221, the collision portion 221*a* becomes a fulcrum point for turning the cleaner main body 201. Therefore, since the distance ratio becomes large or the distance $d_{22}$ is shorter than that of the distance $d_{23}$, the operation characteristic property of the vacuum cleaner may be lower.

In the present invention, even when the caster mounting portions 12 do not project radially outwardly from the cleaner main body, if a bumper member 14 (FIG. 1) is provided at an outer peripheral portion of the cleaner main body 1, the avoidance of the obstacle can nevertheless be achieved in the following manner.

When one of the caster mounting portions 12 collides against the obstacle 21, the cleaner main body can rotate and run forward around the collision portion 21*a* as a fulcrum point for the turning. Then the effects similar to the above stated embodiment in which the caster mounting portions !2 project toward the outside portion of the cleaner main body 1, in other words, the avoidance characteristic property of the obstacle 21 and the cleaner main body 1 can be obtained.

When the vacuum cleaner has no dust collecting portion 7 installed in the cleaner main body, in other words, the dust collecting portion 7 is provided separately from the cleaner main body 1 at a front portion of the suction hose, the height of the cleaner main body 1 can be reduced as the cleaner main body 1 becomes more stable.

Since the suction hose 20 is turnably mounted substantially at the central portion of the upper face of the cleaner main body via the hose coupling 19, the hose coupling 19 can rotate easily toward the operator pulling direction, and, accordingly, the cleaner main body can follow and move smoothly toward the operator.

What is claimed is:

1. A vacuum cleaner comprising:

a cleaner main body, a suction hose for introducing dust into said cleaner main body, a hose coupling for coupling said suction hose to said cleaner main body such that said suction hose is turnably mounted at a substantially central portion of an upper face of said cleaner main body, a plurality of casters for enabling said cleaner main body to be moved relative to a surface to be cleaned by the vacuum cleaner, said casters being mounted on a side wall of a lower portion of said cleaner main body, caster mounting portions for rotatably supporting said casters, and bumper for covering an upper face of the caster mounting portions, wherein said caster mounting portions project outwardly from a side face of said cleaner main body, and said bumpers project from said casters along an outside portion of said caster mounting portion.

2. A vacuum cleaner according to claim 1, wherein said suction hose is mounted so as to be turnable around an axis substantially parallel to a turning axis of the respective casters.

3. A vacuum cleaner according to claim 1, wherein said suction hose is mounted so as to be turnable on said hose coupling.

4. A vacuum cleaner comprising:

a cleaner main body, a suction hose for introducing dust to said cleaner main body, a hose coupling for coupling said suction hose to said cleaner main body so as to be turnably mounted at a substantially central portion of an upper face of said cleaner main body, a plurality of casters mounted on a side wall of a lower portion of said cleaner main body, a dust collection portion provided at said upper portion of said cleaner main body and accommodating a filter member, said dust collecting portion communicating with said suction hose, and an electric drive blower motor for generating a suction force and a cord reel winding apparatus for winding a power source cord are disposed in the lower portion of said cleaner main body.

5. A vacuum cleaner comprising:

a cleaner main body including an upper case for accommodating a dust collecting portion and a lower case for accommodating an electric driven blower motor, a plurality of caster mounting portions provided on a lower portion of said lower case of said cleaner main body, a plurality of casters respectively mounted on a bottom potion of a corresponding one of the caster mounting portions, a suction hose communicating with said dust collection portion, a substantially L-shaped hose coupling for coupling said suction hose at said upper case of said cleaner main body, wherein said hose coupling is provided on a substantially central portion of said upper case of aid cleaner main body, the distance between the installation position of said suction hose by said hose coupling and each of said plurality of caster mounting portions have substantially the same length, and wherein said caster mounting portions project outwardly from a side face of said cleaner main body and bumpers are provided along an outside portion of said caster mounting portions.

* * * * *